US008775192B2

(12) United States Patent
Fu et al.

(10) Patent No.: US 8,775,192 B2
(45) Date of Patent: Jul. 8, 2014

(54) TWO-WIRE DIGITAL AUDIO INTERFACE

(75) Inventors: Jie Fu, Shanghai (CN); Yang Pan, Shanghai (CN); Yongyi Wu, Shangai (CN); Khiem Quang Nguyen, Tewskbury, MA (US)

(73) Assignee: Analog Devices, Inc., Norwood, MA (US)

( * ) Notice: Subject to any disclaimer, the term of this patent is extended or adjusted under 35 U.S.C. 154(b) by 429 days.

(21) Appl. No.: 13/155,840

(22) Filed: Jun. 8, 2011

(65) Prior Publication Data

US 2012/0314874 A1 Dec. 13, 2012

(51) Int. Cl.
*G10L 19/00* (2013.01)
*H04R 5/00* (2006.01)

(52) U.S. Cl.
USPC ..... 704/500; 381/22

(58) Field of Classification Search
USPC ..... 381/22, 23; 700/94; 375/145, 149, 293, 375/215; 370/503, 509; 704/500
See application file for complete search history.

(56) References Cited

U.S. PATENT DOCUMENTS

2004/0080671 A1 4/2004 Siemens et al.
2009/0024235 A1 1/2009 Kim
2010/0007389 A1 1/2010 Li et al.
2010/0077247 A1 * 3/2010 McHarg et al. ..... 713/400
2010/0228881 A1 9/2010 Williams et al.

OTHER PUBLICATIONS

PCT International Search Report and Written Opinion from PCT/US12/39928, mailed on Aug. 21, 2012.

* cited by examiner

*Primary Examiner* — Vivian Chin
*Assistant Examiner* — Ammar Hamid
(74) *Attorney, Agent, or Firm* — Kenyon & Kenyon, LLP

(57) ABSTRACT

A digital audio interface may include two signal inputs to transmit audio data. A first signal line may carry digital serial audio data. The second signal line may carry a word clock signal to differentiate the serial audio data transmitted over the first signal line. In the case of stereo audio data, the word clock signal may correspond to a left-right clock signal and may differentiate audio data intended for a right channel from that intended for a left channel. The audio data may also be differentiated differently depending on the configuration, such as in the case that the transmitted audio data include audio for more than two channels. The word clock signal may be scaled to regenerate a bit clock signal used to encode the serial audio data over the first signal line. The encoding bit clock signal need not be transmitted.

24 Claims, 6 Drawing Sheets

TWO-WIRE DIGITAL AUDIO INTERFACE

RELATED APPLICATION

This application relates to co-pending application "Hybrid Digital-analog Phase Locked Loops," filed as U.S. patent application Ser. No. 13/155,561, also filed on Jun. 8, 2011, which is incorporated herein by reference in its entirety.

BACKGROUND

Audio and multimedia systems often include audio input ports for connecting external audio sources. These audio input ports may include analog input ports with two-wire signal lines, which may include tip, ring, sleeve (TRS) sockets or 3.5 mini jacks, or digital input ports with three or more signal lines.

Integrated Interchip Sound (IIS) is one example of a digital interface standard for connecting audio devices. IIS requires at least three different signal lines. These signal lines include a bit clock line, a left-right clock line to indicate left or right channel audio data, and a multiplexed data line containing the left and right channel audio data. Additional multiplexed signal data lines and a master clock line may also be included in different implementations, further adding to the number of signal lines used to transmit audio. The master clock line may transmit a master clock signal at a higher frequency than the bit clock signal. The master clock signal may be used by a digital signal processor to process the audio data.

As the number of signal lines used to transmit audio increases, production costs and power consumption both increase. Production costs increase because it becomes more expensive to manufacture circuit boards, connectors, and wires to support additional signal lines. For example, not only is there an added materials cost for including the additional pin outs and signal lines on the circuit board, but there is also increased power consumption cost because each added signal line consumes additional power. This increased power consumption may reduce the battery life of portable audio devices between charges, requiring the portable device to be charged more frequently.

Thus, there is a need for a digital audio transmission interface using a minimal number of signal lines to transmit audio.

DETAILED DESCRIPTION

A digital audio interface in an embodiment of the invention may include two signal inputs to carry audio data. A first signal input may be connected to a signal line carrying digital serial audio data. The second signal input may be connected to a signal line carrying a word clock signal to differentiate the serial audio data transmitted over the first signal line. In the case of a stereo audio data, the word clock signal may differentiate, for example, audio data intended for a right channel from the audio data intended for a left channel. In this case, the word clock signal may correspond to a left-right clock signal. In other embodiments, the audio data may be differentiated differently depending on the configuration, such as in the case that the transmitted audio data include audio for more than two channels.

A bit clock may time the transmission of the digital serial audio data bits so that serial audio data is transmitted at a rate corresponding to the bit clock rate. Since the word clock signal may differentiate a subset of serial audio data bits, such as those bits corresponding to a particular audio channel, the word clock signal frequency may be lower than the bit clock frequency. In an embodiment where the word clock signal differentiates left and right channel audio data in the transmitted serial audio data, the frequency of the word clock signal may range from about 8 kHz to about 192 kHz. The frequency of the bit clock signal may, however, be much higher from about 3 MHz to about 12 MHz.

Since only the word clock signal and serial audio data may be respectively transmitted over each of the two signal lines in an embodiment, the bit clock signal, and other signals such as a master clock signal need not be transmitted. Instead these other clock signals may be derived from the transmitted word clock signal at a receiver to enable the receiver to properly decode the transmitted serial audio data. Because the bit clock signals and other higher frequency clock signals requiring additional power for transmission, such as the master clock signal, may no longer be transmitted, overall power consumption may be reduced.

As discussed previously, the received word clock signal may be scaled at a receiver to regenerate the bit clock signal. Since the word clock signal may associate different audio bits with different channels, the word clock signal may be synchronized to the untransmitted bit clock signal. Accordingly, as long as the phase of the scaled word clock signal is matched to that of the word clock signal, the scaled word clock signal may be synchronized to the original bit clock signal that encoded the transmitted audio bits. One or more phase lock loops (PLL) may adjust the phase of the scaled word clock signal to match the original word clock signal. The PLLs may include an analog PLL or a hybrid digital-analog PLL, which may include a digital PLL coupled to an analog PLL.

Figure 1:
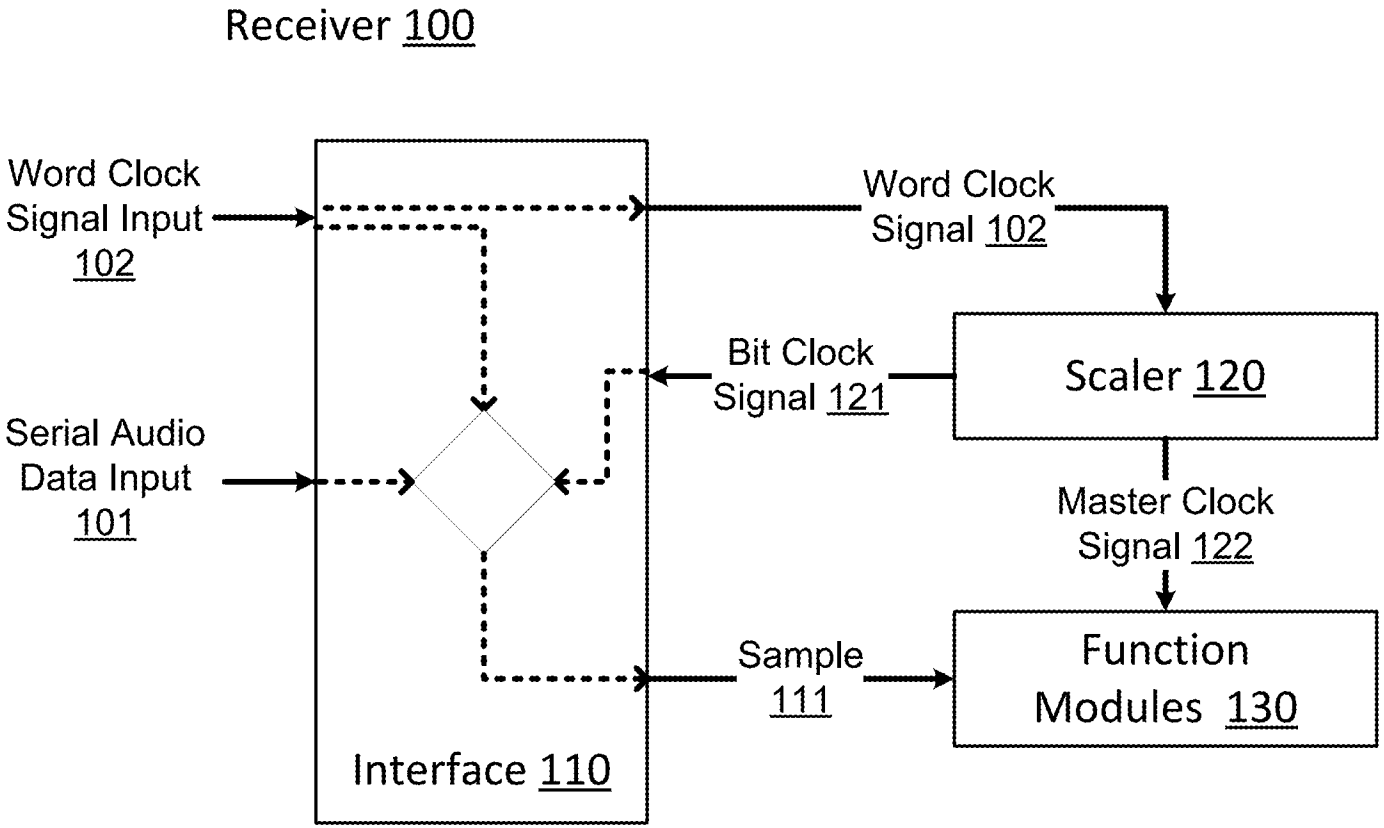
FIG. 1 shows an exemplary system diagram of an audio receiver in an embodiment of the invention.

FIG. 1 shows an exemplary system diagram of an audio receiver 100 in an embodiment of the invention. The receiver 100 may include an interface 110 having two inputs, one for serial audio data 101 and the other for a word clock signal 102. The word clock signal input 102 may be used at the interface 110 when decoding the serial audio data input 101 to differentiate the different type of the audio data included in the serial audio data input 101. For example, if the word clock signal 102 is a left-right clock signal differentiating audio data intended for a right channel from audio data intended for a left channel, then the word clock signal input 102 may identify left channel and right channel audio data at the serial audio data input 101.

The word clock signal input 102 may also be supplied as an input to a signal scaler 120 that scales the word clock signal input 102 to regenerate the bit clock signal 121. The signal scaler 120 may also scale the word clock signal input 102 to one or more additional frequencies depending on the application. For example, the signal scaler 120 may scale the word clock signal 102 to a higher master clock signal frequency 122. This higher master clock signal frequency 122 may be sent to a functional module 130, such as a digital signal processor, to oversample the decoded audio data during signal processing. The signal scaler 120 may also scale the word clock signal input 102 to other frequencies to accommodate other function modules 130.

The signal scaler 120 may include a PLL to adjust the regenerated bit clock signal 121 so that the phase of the regenerated bit clock signal 121 matches the phase of the word clock signal 102. The PLL may include an analog PLL or a hybrid digital-analog PLL having a digital PLL coupled to an analog PLL. The signal scaler 120 may also include one or more frequency multiplier, dividiers, and/or fractional-n synthesizers to scale the word clock signal 102 to regenerate the bit clock signal 121. One or more parameters of the frequency multipliers, dividers, and/or fractional-n synthesizers may be adjustable to accommodate different scaling factors in different applications and embodiments.

Figure 2:
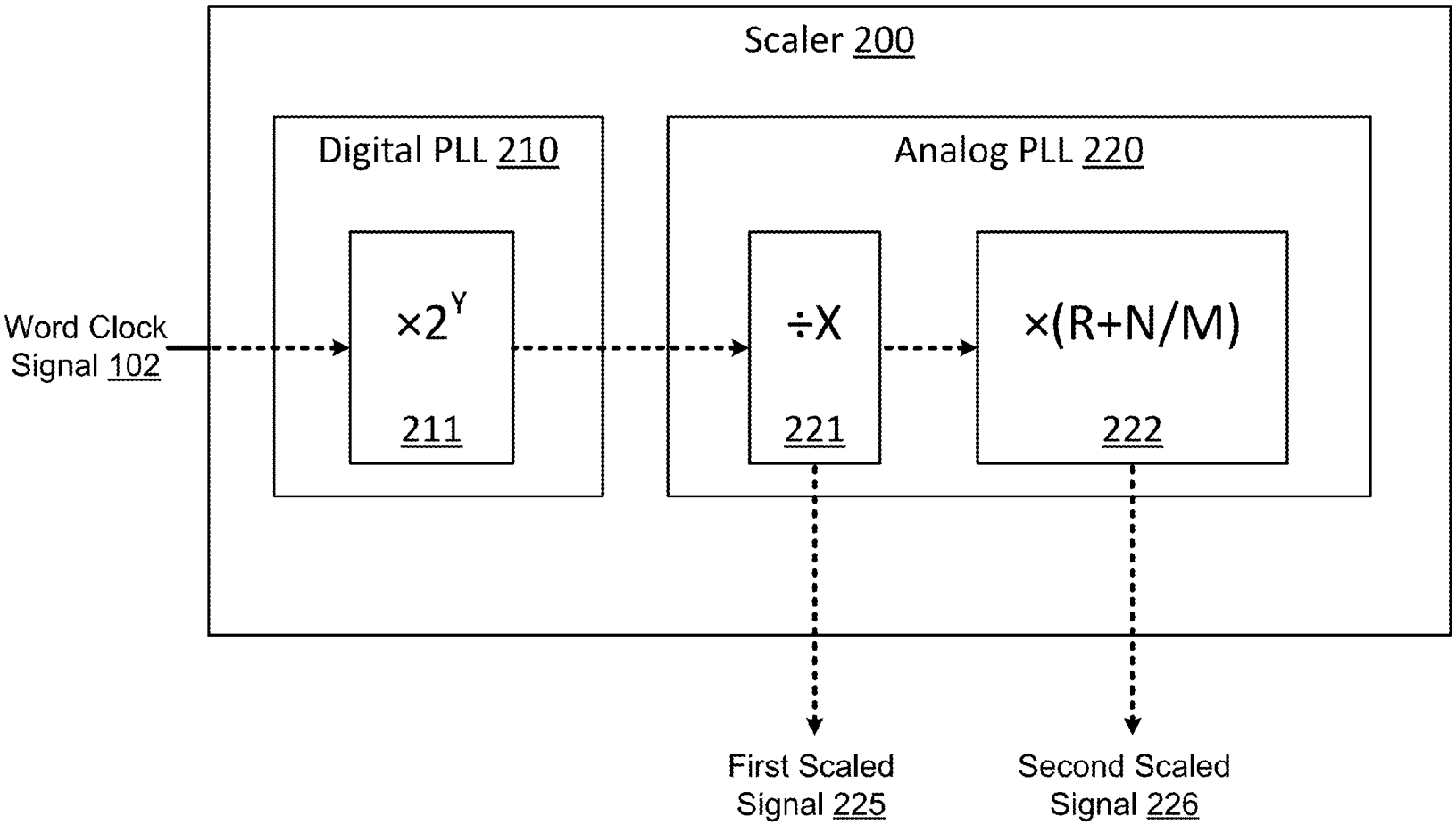
FIG. 2 shows an exemplary configuration of a scaler in an embodiment.

FIG. 2 shows an exemplary configuration of a hybrid digital-analog signal scaler 200 in an embodiment. The hybrid scaler 200 may include a digital PLL 210 coupled to an analog PLL 220. The digital PLL 210 may include a frequency multiplier 211 to scale the word clock signal 102. In an embodiment, the frequency multiplier 211 may multiply the word clock signal frequency by a factor of $2^Y$, where "Y" may be a programmable integer from 0 to 10 that be vary depending on the application. In other embodiments, other multipliers and multiplication factors may be used.

Once the frequency of the word clock signal 102 has been multiplied at multiplier 211, the multiplied frequency may be sent to a coupled analog PLL 220. The analog PLL may include a frequency divider 221, frequency multiplier (not shown), and/or a fractional-n synthesizer 222. The parameters of these frequency dividers, multipliers, and/or fractional-n synthesizers may be programmable to accommodate different desired scaled output frequencies. For example, a divisor of the frequency divider 221, and the parameters R, M, N, resulting in an average frequency multiplier of (R+N/M) for the fractional-n synthesizer 222, may be programmable.

The frequency dividers, multipliers, and/or fractional-n synthesizers may generate one or more scaled frequencies depending on the particular application. For example, as shown in FIG. 2, a frequency divider 221 may scale the multiplied word clock signal from the digital PLL 210 to generate a first scaled signal 225. The first scaled signal 225 may then be outputted, as, for example, a regenerated bit clock signal. The first scaled signal 225 may also be inputted to a fractional-n synthesizer 222, which may generate a second scaled signal 226 different from the first scaled signal 225. The second scaled signal 226, may, for example, correspond to a higher frequency master clock signal for other signal processing functions.

Figure 3:
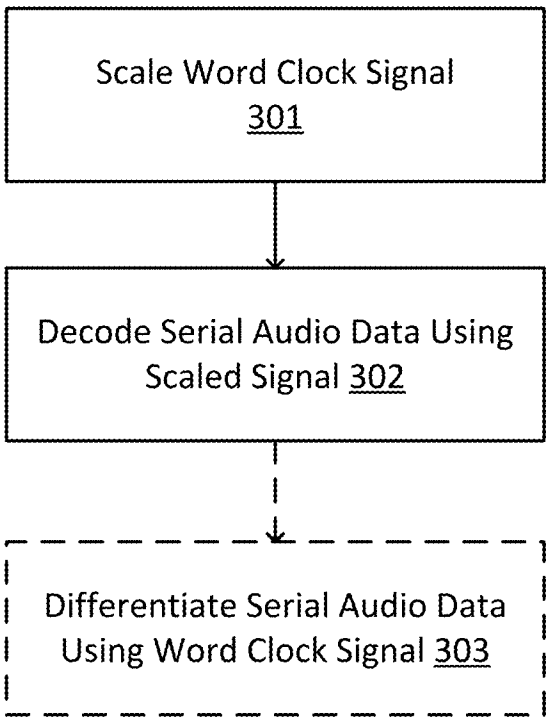
FIG. 3 shows an exemplary process for decoding serial audio data in an embodiment.

FIG. 3 shows an exemplary process for decoding serial audio data in a two signal line digital audio interface where a first signal line carries serial audio data and a second signal line carries a word clock signal used to differentiate at least one set of the audio data.

In box 301, the transmitted word clock signal may be scaled to regenerate a clock signal that encoded the serial audio data. The scaling factor that regenerates the clock signal may be preprogrammed if the encoding clock signal is known and fixed. If the encoding clock signal varies, the parameters of the scaler may be reprogrammed to regenerate a matching clock signal. The reprogramming may occur by providing a clock signal identifier to the scaler to enable the scaler to set its parameters to generate the matching clock signal.

As discussed previously, a phase of the word clock signal may be matched to a phase of the clock signal that encoded the serial audio data. This is because the word clock signal may differentiate different audio bits in the serial audio data stream, so the start of a word clock signal cycle may coincide with the start of a bit cycle representing a first audio bit to be differentiated. Similarly, the end of a word clock signal cycle may coincide with the end of a bit cycle representing a last audio bit to be differentiated.

Thus, as long as the phase of the scaled word clock signal matches a phase of the original word clock signal, the regenerated clock signal may be synchronized to the phase of the original clock signal. A phase lock loop may adjust phase synchronization between the scaled word clock signal and the original word clock signal to maintain synchronization.

In box 302, the scaled word clock signal may assist in decode the serial audio data. Since the word clock signal may be scaled to regenerate the encoding clock signal, the regenerated clock signal may also assist in decoding the serial audio data by identifying audio bits and bit transitions.

In box 303, the decoding of the serial audio data may also include using the original word clock signal to identified the set of the digital audio bits to be differentiated. For example, if the word clock signal differentiates audio bits intended for a left and right audio channels, then the word clock signal may also be used during the decoding to identify those decoded audio bits intended for the left channel and those intended for the right channel.

Figure 4:
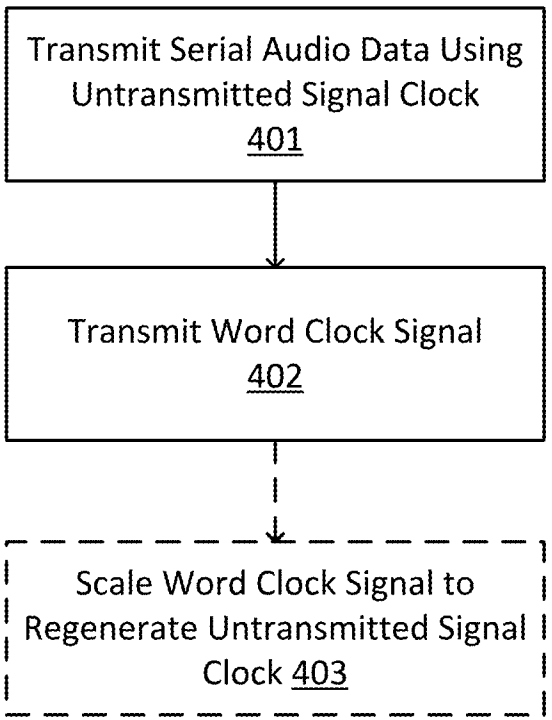
FIG. 4 shows an exemplary process for transmitting serial audio in an embodiment.

FIG. 4 shows an exemplary process for transmitting serial audio in a two signal line digital audio interface where a first signal line carries serial audio data and a second signal line carries a word clock signal used to differentiate at least one set of the audio data.

In box 401, the serial audio data may be encoded and transmitted over the first signal line using a clock signal to encode the audio data. The encoding clock signal need not be transmitted. The serial audio data may include different set of audio data, such as multiple channels of audio data. For example, the serial audio data may include left channel audio data and right channel audio data.

A word clock signal may identify different audio data bits, such as audio data intended for the left and right channels, encoded in the serial audio data. Because the word clock signal may identify particular audio bits, a phase of the word clock signal may match a phase of the audio bit encoding clock signal. This phase matching may enable the word clock signal to identify the start and end of the encoded bits representing a particular set of audio data, such as left or right channel data.

In box 402, the word clock signal may be transmitted over the second signal line. In box 403, the word clock signal may be scaled to regenerate the higher frequency encoding clock signal. As discussed previously, the scaling parameters regenerating the encoding clock signal may be fixed in those instances where the encoding clock signal is fixed and may be variable in those instances where the encoding clock signal frequency may vary. An encoding signal identifier, which may identify the encoding clock signal, or may include one or more scaler parameters, may select the particular encoding clock signal used.

Figure 5:
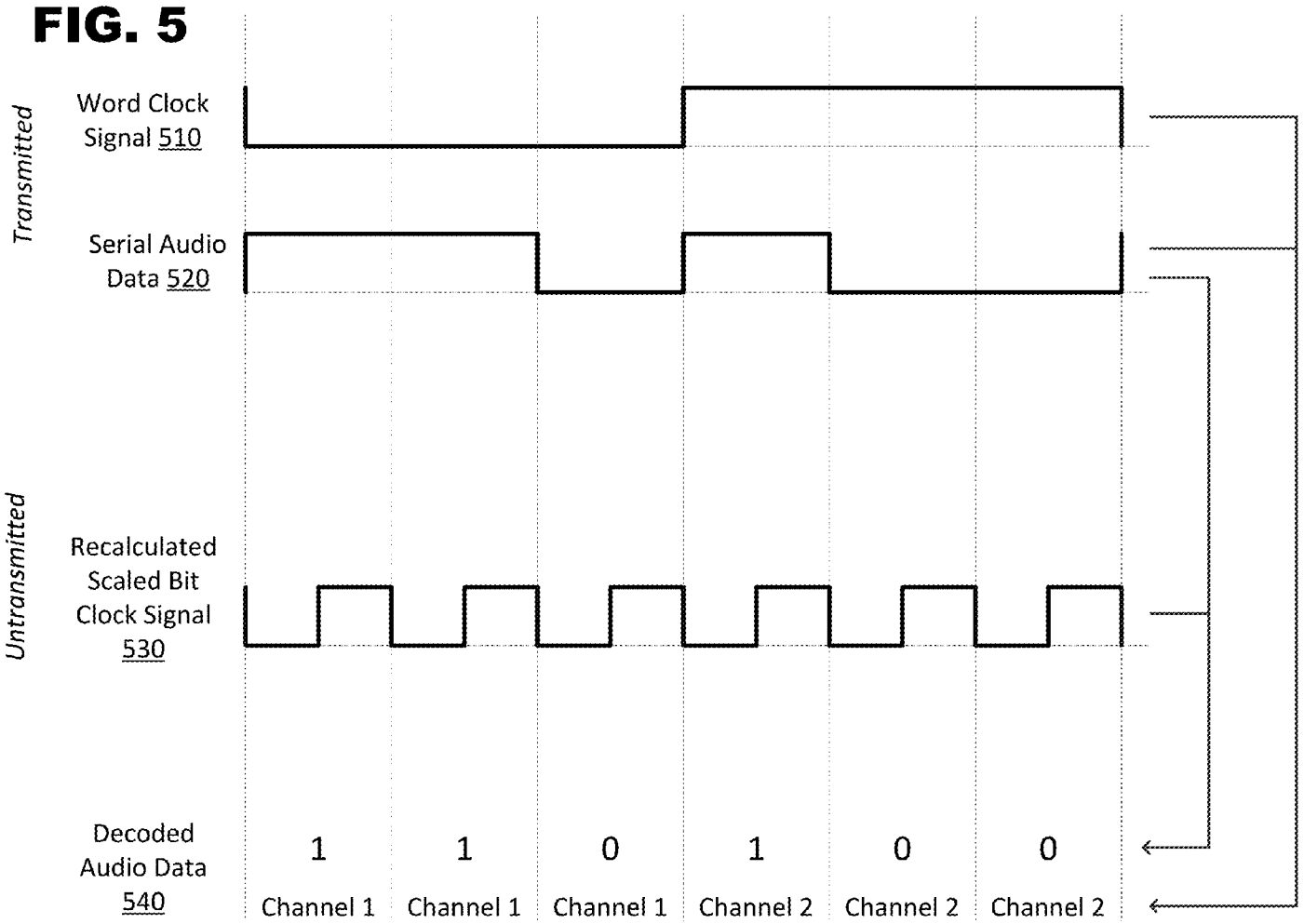
FIG. 5 shows an exemplary signal diagram in an embodiment.

FIG. 5 shows an exemplary signal diagram of a word clock signal 510 and serial audio data signal 520 transmitted over the two respective signal lines in an embodiment. In this example, the serial audio data may have been encoded using a bit clock signal frequency that is six time the word clock signal 510 frequency. Thus, to regenerate this bit clock signal frequency, the word clock signal may be scaled by a factor of six (though other embodiments may use different scaling factors and/or frequencies) and phase matched to the word clock signal 510. This recalculated scaled bit clock signal is shown as untransmitted bit clock signal 530.

Then, at each rising edge of the recalculated and phase matched bit clock signal 530, the serial audio data signal 520 may be sampled to identify and decode the audio bits transmitted over the serial audio data signal 520. In this case, the decoded audio bits 540 may be 110100 (0 for low state and 1 for high state). The word clock signal 510 may also be sample at each rising edge of the recalculated bit clock signal 530 to identify a channel associated with the respective decoded audio bit 540, such as a first channel corresponding to a low signal state and a second channel corresponding to a high signal state. Other variations may be used in other embodiments.

Figure 6:
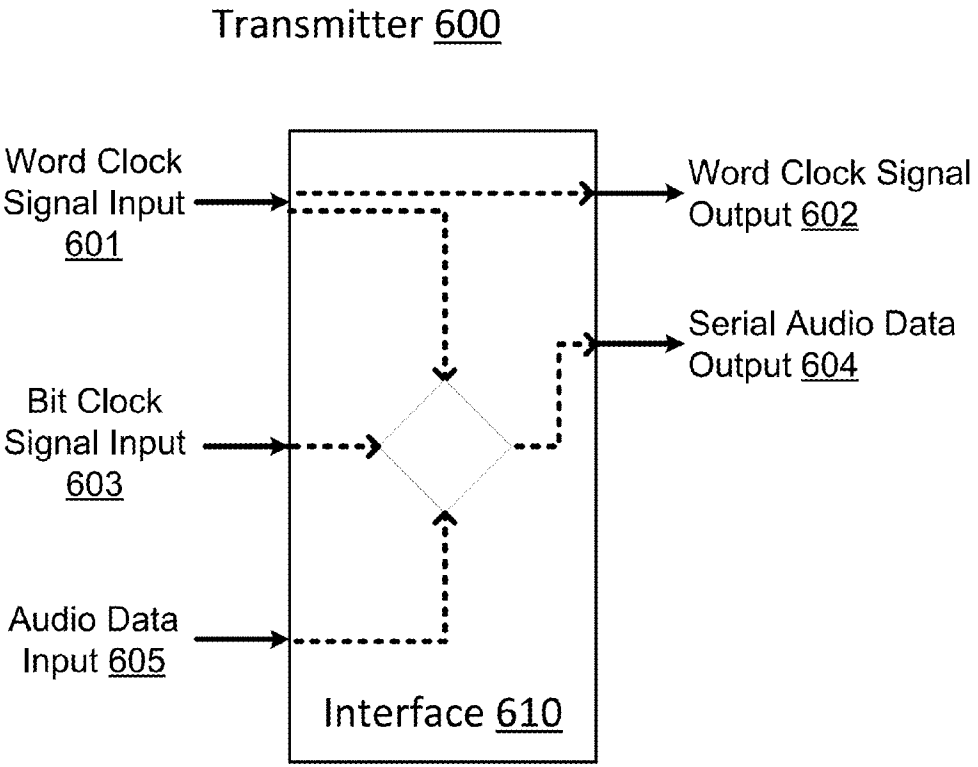
FIG. 6 shows an exemplary transmitter in an embodiment

FIG. 6 shows an exemplary transmitter 600 in an embodiment of the invention. In this embodiment, a transmitter interface 610 may include an input for a word clock signal 601 and/or a bit clock signal 603, in additional to an audio data input 605. The audio data from input 605 may then be encoded into a serial audio data stream using the bit clock signal 603 and/or the word clock signal 601. The bit clock signal 603 may time the transitions between different bits in the serial audio data stream. The word clock signal 604 may be used to differentiate between different bits, such as data bits intended for a first audio channel and data bits intended for a second audio channel. The interface may include a word clock signal output 602 and serial audio data stream output 604 for outputting the serial audio data stream and the word clock signal. In an embodiment, the bit clock signal 603 need not be transmitted.

Figure 7:
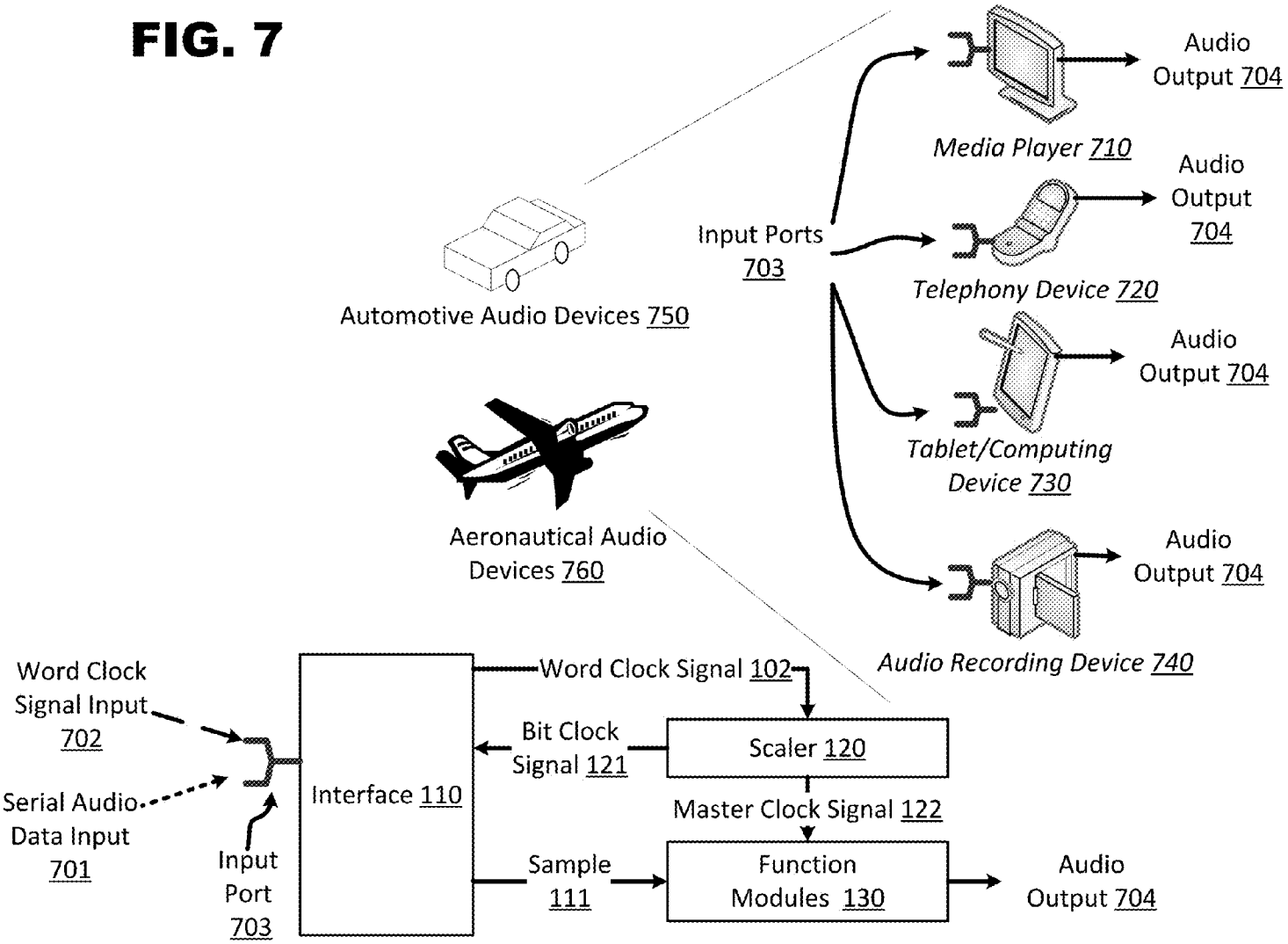
FIG. 7 shows a plurality of exemplary audio devices and applications in which embodiments of the invention may be used.

FIG. 7 shows a plurality of exemplary audio devices, such as, for example, media player 710, telephony device 720, tablet/computing device 730, and audio recording device 740, and applications in which embodiments of the invention may be used, including, but not limited to, automotive audio devices 750 and aeronautical audio devices 760. Each of these devices may include an input port 703 with a serial audio data signal input 701 and word clock signal input 702. Each input port 703 may be coupled to an interface 110, scaler 120, and/or one or more function modules 130 for processing the audio data. Each of the devices may also include an audio output 704, which may include a speaker for playing the audio or an output port for outputting the audio signal. In some instances, the output port may include two outputs, one for the word clock signal and one for the serial audio data stream, which may correspond to the output generated from transmitter 600. In other embodiments, other output formats may also be used.

The foregoing description has been presented for purposes of illustration and description. It is not exhaustive and does not limit embodiments of the invention to the precise forms disclosed. Modifications and variations are possible in light of the above teachings or may be acquired from the practicing embodiments consistent with the invention. For example, some of the described embodiments may refer to scalers having digital and analog phase lock loops, but other scalers may include only analog phase lock loops. Similarly, different scaler configurations may include different combinations of one or more frequency multipliers, frequency dividers, fractional-n synthesizers, delta-sigma synthesizers, and/or other scaling circuits.

We claim:

1. A two signal input digital audio interface comprising:

a first signal input to carry serial audio data; and a second signal input to carry a word clock signal to differentiate the serial audio data in a first signal line, wherein the word clock signal is scaled to generate an untransmitted clock signal to decode the serial audio data in the two signal input digital audio interface.

2. The two signal input digital audio interface of claim 1, wherein the word clock signal is scaled to generate an untransmitted bit clock signal and an untransmitted master clock signal.

3. The two signal input digital audio interface of claim 1, wherein a clock rate of the word clock signal ranges from about 8 kHz to about 192 kHz and a scaled clock rate of the untransmitted clock signal ranges from about 3 M Hz to about 12 M Hz.

4. The two signal input digital audio interface of claim 1, further comprising a scaler to scale the word clock signal.

5. The two signal input digital audio interface of claim 4, wherein the scaler includes a digital phase lock loop containing a frequency multiplier to multiply a frequency of the word clock signal.

6. The two signal input digital audio interface of claim 4, wherein the scaler includes an analog phase lock loop containing a frequency divider to divide a frequency of an analog phase lock loop input signal.

7. The two signal input digital audio interface of claim 5, wherein the scaler includes an analog phase lock loop coupled to the digital phase lock loop, the analog phase lock loop including:

a first frequency divider to divide a signal frequency used as a reference input to a phase detector in the analog phase lock loop; and a second frequency divider to divide a phase detector feedback path signal frequency.

8. The two signal input digital audio interface of claim 5, wherein the scaler includes an analog phase lock loop coupled to the digital phase lock loop, the analog phase lock loop including a frequency divider to generate a first scaled signal frequency of a digital phase lock loop output signal and a fractional-n synthesizer to further scale the first scaled signal frequency to generate a second scaled signal frequency.

9. The two signal input digital audio interface of claim 5, wherein the digital phase lock loop frequency multiplier multiplies a frequency of the word clock signal to a frequency higher than 8 MHz.

10. The two signal input digital audio interface of claim 8, wherein each frequency multiplier, frequency divider, and fractional-n synthesizer is programmable.

11. The two signal input digital audio interface of claim 10, wherein the frequency multiplier and the frequency divider are programmed to generate a selected bit clock signal frequency from an identified work clock signal frequency and the fractional-n synthesizer is programmed to generate a selected master clock signal frequency from the selected bit clock signal frequency.

12. A method comprising:

scaling a frequency of a word clock signal transmitted over a first signal line of a two signal line digital audio interface, the word clock signal differentiating a set of serial audio data transmitted over a second signal line of the two signal input digital audio interface; and decoding the serial audio data using the scaled word clock frequency.

13. The method of claim 12, further comprising differentiating the set of serial audio data according to the word clock signal.

14. The method of claim 13, wherein the word clock signal differentiates serial audio data intended for a left audio channel and a right audio channel and the differentiating of the serial audio data includes identifying serial audio data intended for the left and the right audio channels.

15. A method comprising:

transmitting digital serial audio data over a first signal line of a two signal line digital audio interface at an untransmitted clock rate; and transmitting a word clock signal over a second signal line of the two signal line digital audio interface, the word clock signal differentiating a set of the digital serial audio data, wherein the word clock signal is scaled to recalculate the untransmitted clock rate and decode the transmitted digital serial audio data.

16. A two signal input digital audio receiver comprising:

a first signal input to receive serial audio data encoded according to an untransmitted clock signal;

a second signal input to receive a word clock signal differentiating a set of the serial audio data in a first signal line;

a scaler to scale the word clock signal and regenerate the untransmitted clock signal; and a decoder to decode the received serial audio data using the regenerated clock signal.

17. The digital audio receiver of claim 16, wherein a word clock signal phase matches an untransmitted clock signal phase and the scaler includes a phase lock loop to adjust a regenerated clock signal phase to match the word clock signal phase.

18. A two signal output digital audio transmitter comprising:

a first signal output to carry digital audio data;

an interface to serially transmit the digital audio data at the first signal output according to an untransmitted clock signal;

a second signal output to carry a word clock signal differentiating a set of the digital audio data carried over the first signal line, the word clock signal representing a scaled variation of the untransmitted clock signal; and an audio device having at least one output port coupled to the first and second signal outputs of the two signal input digital audio transmitter.

19. The two signal input digital audio interface of claim 1, further comprising an audio device including the two signal input digital audio interface.

20. The two signal input digital audio interface of claim 19, wherein the audio device is a computing device.

21. The two signal input digital audio interface of claim 19, wherein the audio device is a media player.

22. The two signal input digital audio interface of claim 19, wherein the audio device is an automotive audio device embedded in an automotive audio system.

23. The two signal input digital audio interface of claim 19, wherein the audio device is an aeronautical audio device embedded as part of an aircraft audio system.

24. The two signal input digital audio receiver of claim 16 further comprising an audio device having at least one input port coupled to the first and second signal inputs of the two signal input digital audio receiver.

* * * * *

UNITED STATES PATENT AND TRADEMARK OFFICE

CERTIFICATE OF CORRECTION

PATENT NO. : 8,775,192 B2
APPLICATION NO. : 13/155840
DATED : July 8, 2014
INVENTOR(S) : Jie Fu et al.

It is certified that error appears in the above-identified patent and that said Letters Patent is hereby corrected as shown below:

On Title page, Item "(75) Inventors", please change:

"Yongyi Wu, Shangai (CN)" to --Yongyi Wu, Shanghai (CN)--;

On Title page, Item "(75) Inventors", please change:

"Khiem Quang Nguyen, Tewskbury, MA (US)" to --Khiem Quang Nguyen, Tewksbury, MA (US)--;

In the Claims

Column 6, line 10, please change:

"8 kHz" to --8kHz--;

Column 6, line 10, please change:

"192 kHz" to --192kHz--;

Column 6, line 11, please change:

"3 M Hz" to --3MHz--;

Column 6, line 12, please change:

"12 M Hz" to --12MHz--;

Column 6, line 43, please change:

"8 MHz" to --8MHz--.

Signed and Sealed this
Third Day of February, 2015

Michelle K. Lee

Michelle K. Lee
*Deputy Director of the United States Patent and Trademark Office*